United States Patent [19]

Westphal

[11] 4,428,741

[45] Jan. 31, 1984

[54] METHOD FOR FORMING A SEAM RELEASE STRIP COMPOSITE CONTAINER

[75] Inventor: Teddy M. Westphal, Glencoe, Mo.

[73] Assignee: Boise Cascade Corporation, Boise, Id.

[21] Appl. No.: 443,700

[22] Filed: Nov. 22, 1982

Related U.S. Application Data

[62] Division of Ser. No. 271,027, Jun. 4, 1981, Pat. No. 4,376,506.

[51] Int. Cl.[3] ..... B65D 3/14

[52] U.S. Cl. ..... 493/103; 493/87; 493/109

[58] Field of Search ..... 493/109, 108, 103, 102, 493/87, 158, 159; 229/5.6

[56] References Cited

U.S. PATENT DOCUMENTS

| | | | |
|---|---|---|---|
| 2,986,319 | 5/1961 | Bierman et al. | 229/5.6 |
| 3,070,446 | 12/1962 | Seiferth et al. | 229/5.6 UX |
| 3,330,436 | 7/1967 | Slomski | 229/5.6 X |
| 3,409,200 | 11/1968 | Balocca et al. | 229/5.6 |
| 3,580,464 | 5/1971 | Griffith | 229/5.6 |
| 3,933,298 | 1/1976 | Ellerbrock et al. | 229/5.6 |

*Primary Examiner*—James F. Coan

*Attorney, Agent, or Firm*—Laubscher, Philpitt & Laubscher

[57] ABSTRACT

A composite container for fluent materials in the liquid or semi-frozen state is disclosed, together with a method for making the same. The container includes a vertically arranged body member that is flared at its upper end, and an end closure member is provided including a circular central panel portion arranged within and extending across the upper end of the body member, annular chuck wall portion extending upwardly from the central panel portion adjacent the flared portion of the body member, and an annular connecting flange portion extending radially outwardly from the upper end of the chuck wall portion. The invention is characterized in that the connecting flange and chuck wall portions cooperate with the flared portion of the body member to define an annular space in which is arranged a resilient annular mass of sealing material. A seam release strip is arranged circumferentially about the outer surface of the upper portion of the body member, the connecting flange portion of the end closure being inwardly crimped into engagement with the body member and the seam release strip, thereby causing the mass of sealing material to be compressed to seal the annular space between the end closure member and the body member.

3 Claims, 3 Drawing Figures

METHOD FOR FORMING A SEAM RELEASE STRIP COMPOSITE CONTAINER

This application is a division of application Ser. No. 271,027, filed June 4, 1981 now U.S. Pat. No. 4,376,506.

BACKGROUND OF THE INVENTION

The present invention relates to a seam release strip type composite container for fluent materials in the liquid or semi-frozen state, and to a method for making the same. Seam release strip composite containers are well known in the art, as illustrated by the U.S. patent to Balocca U.S. Pat. No. 3,142,433, Slomski U.S. Pat. No. 3,330,436, and Ellis U.S. Pat. No. 3,367,531. However, the seam release strip composite containers of the prior art have generally been used for packaging products, such as juice concentrates in a frozen condition, and consequently they do not provide adquate container end closure sealing means for holding fluent materials in the liquid or semi-frozen state.

In the prior art devices, it has proven difficult to provide a seam release strip composite container with a container end closure sealing means which prevent outward seepage of materials in the liquid or semi-frozen state. On the one hand, a tighter crimp seam does not allow for easy manual removal of a plastic seam release strip from under the crimped seam, while on the other hand, a larger end closure member which provides a tighter fit between the container end closure and composite body wall does not provide adequate space between the end closure and body wall to allow insertion of the end closure into the container body without disturbing the inner layers of the composite body wall.

The present invention was developed to avoid the above and other drawbacks of the prior art.

SUMMARY OF THE INVENTION

Accordingly, a primary object of the present invention is to provide a seam release strip composite container for fluent materials in the liquid or semi-frozen state and a method for making the same, which container includes adequate end closure sealing means for preventing any outward seepage of the fluent materials contained therein. In accordance with the present invention, the upper end of the composite body member is initially flared outwardly, and the end closure member has such a configuration that the area adjacent the juncture of the chuck wall and flange portions cooperates with the inner surface of the flared body portion to define an annular space in which is arranged a resilient annular bead of sealing material. When the curled extremity of the flange is radially inwardly crimped into engagement with the body member and a circumferentially arranged seam release strip, the mass of sealing material is compressed to seal the annular space between the end closure member and the body member. Consequently, the seam release strip may be relatively easily removed from the space between the flared body portion and the curled portion of the end closure for simple manual removal of the end closure.

A further object of the present invention is to provide a seam release strip composite container for fluent materials in the liquid or semi-frozen state, and a method for making the same, which allow the container to be produced efficiently on high speed production equipment.

BRIEF DESCRIPTION OF THE DRAWING

Further objects and advantages of the present invention will become apparent from a study of the following detailed description when viewed in the light of the accompanying drawing, in which.

DETAILED DESCRIPTION

Figure 1:
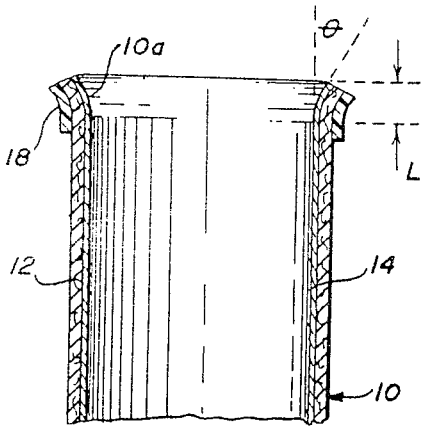
FIG. 1 is a vertical cross-sectional view of the upper portion of the composite container body member in accordance with the present invention.

Referring now to FIG. 1, the seam release strip composite container of the present invention comprises a cylindrical, vertically arranged body member 10 which includes a helically wound fibrous body wall layer 12 and a concentrically arranged fluid impervious inner liner layer 14 bonded thereto.

The upper portion 10*a* of body member 10 is flared radially outwardly as is shown in FIG. 1, which flaring may be achieved by insertion of a cone-like tapered tool into the upper end of the body member, thereby forcing the upper portion thereof radially outwardly. The length, L, of the flared upper portion 10*a* of the body member may vary depending on the diameter of the seam release strip composite container. The preferred length, L, however, in accordance with presently manufactured size of seam release strip composite containers is approximately one sixteenth of an inch. Similarly, the angle $\theta$ from the vertical, by which the upper portion of body member 10 is flared radially outwardly, may vary from about 15 to about 30 degrees.

The flaring of the upper portion 10*a* of body member 10 eliminates any inward protrusion which may result from cutoff knives which crush cut a spirally wound tube into the appropriate length body members 10. The flaring further provides the body member with a necessary configuration which contributes to the improved sealing means of the present invention, as set forth in greater detail below.

A seam release strip 18 is circumferentially arranged about the outer side of the upper end portion of body member 10, which seam release strip 18 is formed of a suitably resilient plastic material having a relatively high tensile strength (for example, polyethylene).

Figure 2:
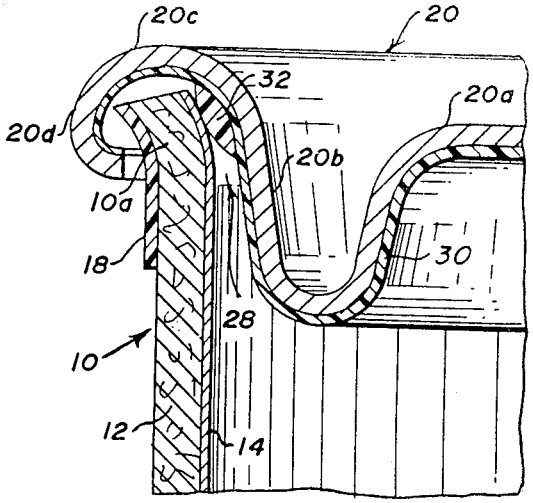
FIG. 2 is a detailed sectional view illustrating the initial insertion of the container end closure member in the container body member.

With reference to FIG. 2, rigid metal end closure member is provided for closing the upper end of body member 10. The end closure member 20 includes a circular central panel portion 20*a* arranged within and extending transversely across the upper end of said body member, an annular chuck wall portion 20*b* extending upwardly from central panel portion 20*a* adjacent the outwardly flared portion 10*a* of body member 10, and an annular connecting flange portion 20*c* extending radially outwardly from the upper end of chuck wall portion 20*b*, the connecting flange portion 20*c* and the chuck wall portion 20*b* cooperating with the inner surfaces of body member flared portion 10*a* and the adjacent portion of body member 10, respectively, to define an annular space 28.

End closure member 20 further includes a protective film coating 30 on its inner surface, the coating preferably being a modified dispersion vinyl. The importance of coating layer 30 will be discussed in detail below.

Annular space 28 is an important feature for providing the improved seam release strip composite container of the present invention. This space allows for the insertion of end closure member 20 within the upper portion of body member 10 without disturbing the body wall layer 12 or inner liner layer 14, and further allows for the location of an annular mass of sealing material 32 in at least the upper portion of annular space 28 opposite body member flared portion 10*a*.

Sealing material 32 is applied as an annular bead adjacent the junction between connecting flange portion 20*c* and chuck wall portion 20*b* of end closure member 20 prior to insertion of end closure member 20 into body member 10. In the seam release strip composite container of the present invention the location of sealing material 32 in at least the upper portion of annular space 28 contributes to the adequate sealing barrier means which prevent the seepage of fluent materials in the liquid or semi-frozen state from the container.

Preferably, sealing material 32 is a plastisol compound which is applied to end closure member 20 in a 100% solids-liquid dispersion. End closure member 20 is heated to a temperature sufficient to plasticize the annular bead of plastisol compound and adhere the same to coating layer 30 on the inner surface of end closure member 20 adjacent the junction between the chuck wall portion 20*b* and the flange portion 20*c*.

To ensure that the annular space 28 is of a width sufficient to allow annular mass of sealing material 32 to be arranged therein, container end closure member 20 may be slightly smaller than the end closure member generally employed in seam release strip composite containers. For example, with reference to FIG. 3 and in accordance with the present invention, an end closure member with an outside chuck wall diameter, $d_1$, of 2.542 inches may be used successfully with a body member having an inside diameter, $d_2$ of 2.576 inches.

Figure 3:
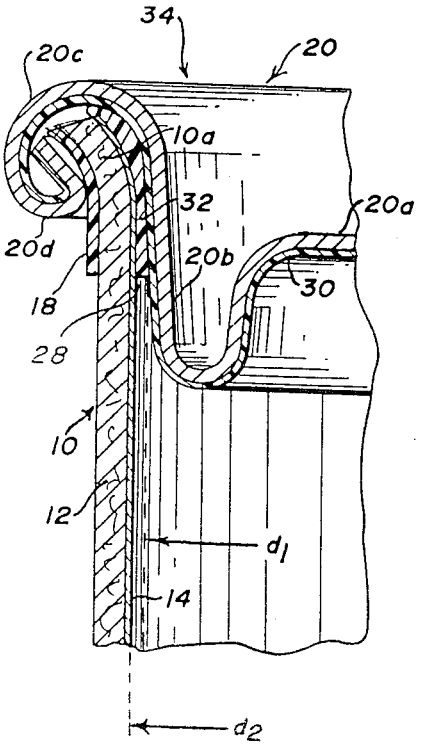
FIG. 3 is a sectional view of the assembled seam release strip composite container of the present invention.

With reference to the seam release strip composite container 34 of FIG. 3, connecting flange portion 20*c* terminates in a curled extremity 20 *d* which is inwardly crimped into connecting engagement with body member 10 and seam release strip 18. The annular mass of sealing material 32 is thereby compressed to seal annular space 28 to prevent fluent materials in the liquid or semi-frozen state from seeping through the upper end portion of the container. Standard seaming rolls and techniques may be employed in the crimping process. The seam dimensions employed should allow the seam release strip 18 to be removed under pull forces corresponding to those necessary for convention seam release strip containers.

Upon easy manual removal of the seam release strip from engagement in the crimped seam, end closure member 20 is released from locking engagement with body member 10. As end closure member 20 is easily lifted from its position adjacent body member 10, sealing material 32 continues to adhere to coating layer 30 and is removed therewith, thereby preventing said sealing material from mixing with the contents of container 34.

While the preferred forms and embodiments of the invention have been illustrated and described, it will be apparent that modifications may be made without deviating from the scope of the invention set forth above.

What is claimed is:

1. A method for forming a composite container for fluent material in the liquid or semi-frozen state comprising the steps of:

(a) providing a spirally wound, vertically arranged cylindrical body member including concentrically arranged fibrous body wall and fluid impervious inner liner layers;

(b) flaring the upper end portion of said body member radially outwardly approximately 15 to 30 degrees relative to the vertical to form a terminating flared portion having a length of approximately one-sixteenth of an inch;

(c) arranging a seam release strip circumferentially about at least the flared portion of said body member;

(d) providing an end closure member for closing the upper end of said body member, said closure member comprising:

(1) a circular central panel portion;

(2) an annular chuck wall portion extending upwardly from said central panel portion; and (3) an annular connecting flange portion extending radially outwardly from the upper end of said chuck wall portion;

(e) applying an annular bead of sealing material adjacent the junction between said flange and chuck wall portions of said end closure member;

(f) positioning said end closure member relative to the upper end of said body member to place said central panel portion within and extending transversely across the upper end of said body member and to place said chuck wall portion adjacent the outwardly flared portion of said body member, said connecting flange and chuck wall portions cooperating with the inner surfaces of said body member flared portion and the adjacent portion of said body member, respectively, to define an annular space, whereby said annular bead of sealing material is contained in at least the upper portion of said annular space; and (g) crimping said connecting flange portion inwardly into connecting engagement with said body member and said seam release strip without causing substantial deformation of said body member, thereby causing said mass of sealing material to seal the annular space between the end closure member and the body member, whereby upon pulling of the seam release strip, the end closure member is released for removal from said body member.

2. A method for forming a composite container as defined in claim 1, wherein said sealing material is a plastisol, and further including the preliminary step of heating said end closure member to plasticize the annular bead of sealing material and causing the same to adhere to said end closure member.

3. A method for forming a composite container as defined in claim 2, and further including the step of coating the inner surface of said end closure member with a modified dispersion vinyl coating layer prior to the application of said sealing material, whereby when said end closure member is removed from said body member, said mass of sealing material adheres to said vinyl coating layer and is removed therewith.

* * * * *